United States Patent [19]

Nozaki et al.

[11] Patent Number: 4,616,880

[45] Date of Patent: Oct. 14, 1986

[54] CONTINUOUS EXCAVATING MACHINE

[75] Inventors: Yasuo Nozaki, Hyogo; Yoshikazu Oishi, Kakogawa; Takanori Koga, Akashi, all of Japan

[73] Assignee: Kawasaki Jukogyo Kabushiki Kaisha, Kobe, Japan

[21] Appl. No.: 451,972

[22] Filed: Dec. 21, 1982

[30] Foreign Application Priority Data

Dec. 26, 1981 [JP] Japan ..... 56-212168

[51] Int. Cl.[4] ..... E02F 3/18; E21C 35/20

[52] U.S. Cl. ..... 299/39; 299/64; 299/67; 299/89; 37/190

[58] Field of Search ..... 299/39, 64, 67, 89, 299/76, 78, 79; 198/308; 56/134, 135; 37/190

[56] References Cited

U.S. PATENT DOCUMENTS

| | | | |
|---|---|---|---|
| 1,552,715 | 9/1925 | Lutz | 198/308 |
| 2,751,207 | 6/1956 | Barrett | 299/89 X |
| 3,290,096 | 12/1966 | Stalker | 299/78 |
| 3,804,466 | 4/1974 | Cilles | 299/78 |
| 3,897,109 | 7/1975 | Satterwhite | 37/190 X |
| 3,982,340 | 9/1976 | Satterwhite | 299/64 X |
| 4,047,763 | 9/1977 | Gillilanz et al. | 299/76 |
| 4,183,158 | 1/1980 | Satterwhite | 37/190 |
| 4,193,636 | 3/1980 | Jakob | 37/190 X |

FOREIGN PATENT DOCUMENTS

| | | |
|---|---|---|
| 481143 | 8/1974 | Australia . |
| 508866 | 2/1976 | Australia . |
| 509160 | 6/1976 | Australia . |
| 498999 | 6/1976 | Australia . |

*Primary Examiner*—James A. Leppink
*Assistant Examiner*—Michael A. Goodwin
*Attorney, Agent, or Firm*—Marshall, O'Toole, Gerstein, Murray & Bicknell

[57] ABSTRACT

This disclosure relates to a continuous excavator for use in open-pit mining, which comprises a self-propelled main frame, a rotating cutter drum supported by pivotal booms and having cutter bits on its outer periphery for excavating the ground material, and a scraper supported behind a lower portion of said drum which collects earth/rock material dug by the cutter bits. An upward conveyor is supported on the frame and slopes upwardly to convey up the earth/rock material from the scraper. Another pivotable conveyor is supported at one end on the frame below the upper end of the upward conveyor, and it is pivotable both horizontally and vertically in order to convey the earth/rock material from the upward conveyor out of the excavator to a desired location.

3 Claims, 5 Drawing Figures

CONTINUOUS EXCAVATING MACHINE

The present invention relates to a continuous excavator for use, for example, in open-pit mining, which is capable of digging and conveying material continuously using a single machine.

A prior art type of continuous excavator used for example in open-pit mining is a bucket wheel excavator, which includes a rotating wheel having a plurality of buckets including cutters. The cutters dig into the earth or other material and the dug earth and rocks are received by the buckets and then successively loaded onto a rearwardly extending belt conveyor as the bucket wheel rotates. The earth and rocks are then transferred from the belt conveyor to another pivotable belt conveyor which conveys them outwardly in a desired direction. Thus, such an excavator can continuously dig and handle a large amount of material.

However, the bucket excavator construction has a limit in strength of digging rocks, and it also has a very low accuracy in selectively digging a rock bed or a coal layer, for example, which form multiple adjacent strata.

A continuous excavator for an underground pit mine is also known, which is moved by endless tracks or crawlers while a cutter drum is rotated, the drum having a number of cutter bits. The dug earth and rocks are conveyed rearwardly by a belt conveyor. Such an excavator has a small size because of its underground use, and the conveyor is located out of the way of the crawlers, etc., and consequently its capacity is low and it is not possible to convey to a high elevation as is required for loading a dump truck.

It is a principal object of this invention to provide an improved continuous excavator that is particularly suited for open-pit mining, which can rapidly excavate and convey a large amount of coal and/or a rock bed of the type which can be broken up. The excavator is also able to selectively excavate a layer of coal or a rock bed forming adjacent strata, and to excavate each layer with a predetermined grading.

An excavator according to this invention comprises a cutter drum having cutter bits embedded in its outer surface, the drum being rotated to dig into earth materials, a scraper adjacent the drum for collecting the earth materials, a relatively steeply sloping upwardly extending conveyor and a pivotable belt conveyor, the scraper and conveyors being provided in the main body of the excavator. The main body is provided with crawlers for moving the excavator.

The invention and further objects and advantages will be better understood from the following detailed description of preferred embodiments, taken in conjunction with the accompanying drawings, wherein.

Figure 1:
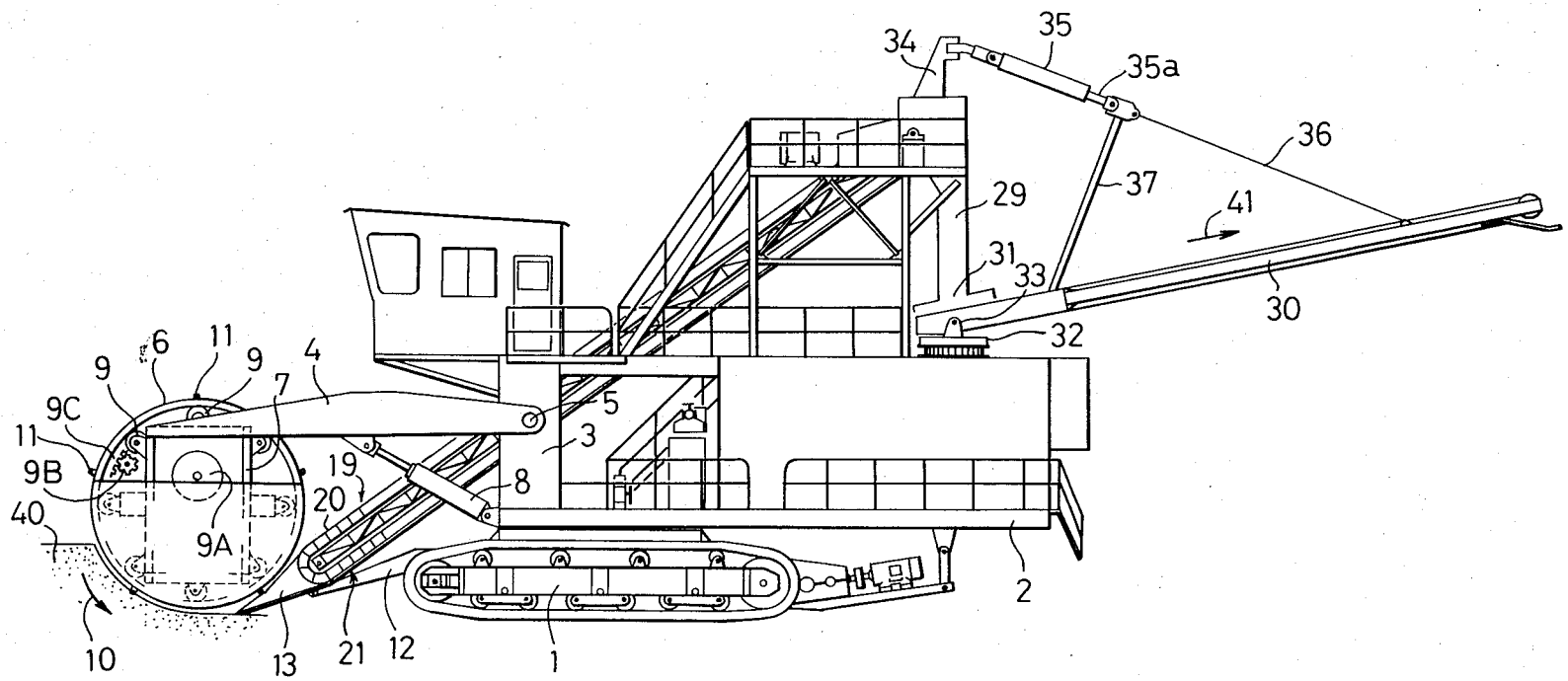
FIG. 1 is an elevational view of an excavator according to this invention.
Figure 2:
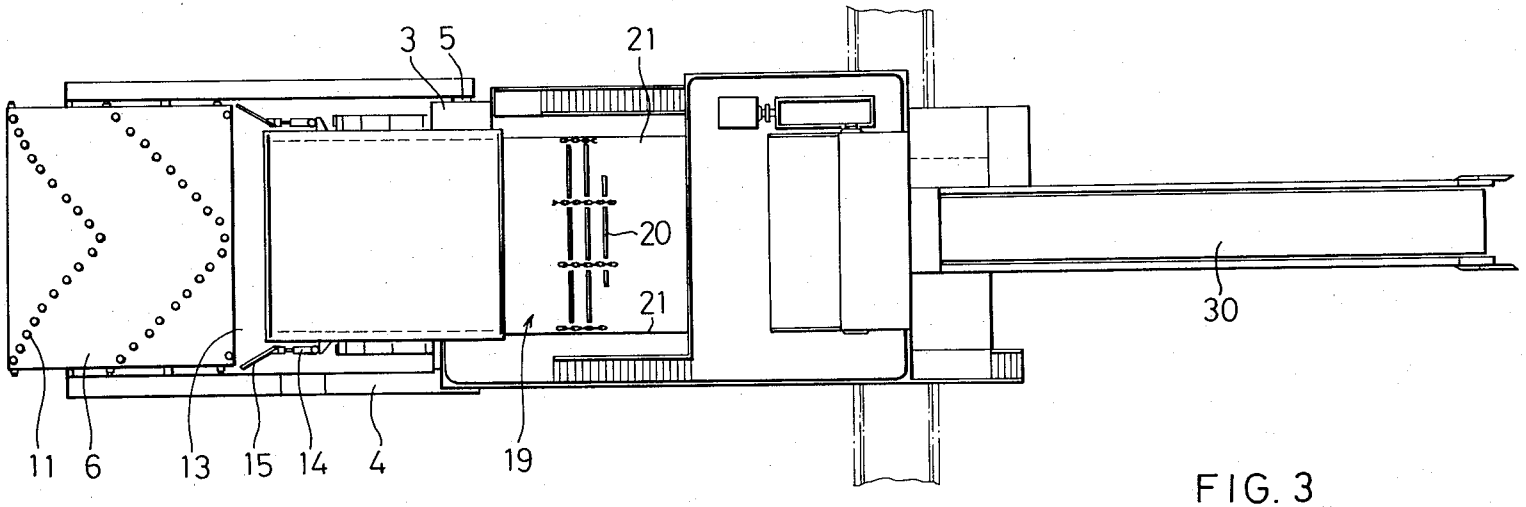
FIG. 2 is a plan view of the excavator.

With reference to FIGS. 1 and 2, the excavator comprises a main frame including a generally horizontal platform 2 that is mounted on endless tracks or crawlers 1 for movement over the ground. The frame further includes a pair of vertical pillars 3 adjacent the front of the platform 2, and a forwardly extending boom 4 is pivoted on the pillars 3 by a large pin 5. The booms 4 have a drum frame 7 mounted adjacent their forward ends, and the frame 7 supports a cutter drum 6 which extends between the booms 4. Connected between the central area of each boom 4 and the main frame is a hydraulic cylinder 8, which is used to pivot the forward end of the boom 4 up and down.

The frame 7 is provided with a plurality of rollers 9 which engage the inside of cutter drum 6 for rotation of the drum. The frame 7 supports drives and reduction gears for rotating the drum in the counterclockwise direction 10 on the frame. For example, the drive may include an electric motor 9A mounted on the frame 7 and reduction gearing 9B connected between the motor and an internal ring gear 9C secured to the drum. A conventional engine-generator set (not shown) may be mounted on the platform 2 for powering the motor 9A, as well as driving motors for powering the crawlers 1, conveyors to be described, and various other mechanisms.

As best shown in FIG. 2, the cutter drum 6 has a number of rows of cutter bits 11, the bits 11 of each row being arranged in a wedge-shaped pattern with the apex of each wedge trailing (in the direction of motion) the ends of the wedge. The bits on the outer periphery dig into the earth material as the drum 6 rotates, and the wedges crowd the material toward the center of the drum.

Located behind the lower portion of cutter drum 6 is a scraper 13 (FIG. 1) which is pivotable by a pin connection with the forward ends of arms 12 that project from the front end of the lower part of the main frame. The scraper 13 can pivot on the pin connection by means of hydraulic cylinders 14 as shown in FIG. 2, to an optimum angle for collecting material that has been dug up by the cylinder 6. The fore end of scraper 13 has a width substantially the same as that of the cutter drum 6 to facilitate the collection of the earth and rock materials dug up by the cutter bits 11.

Figure 3:
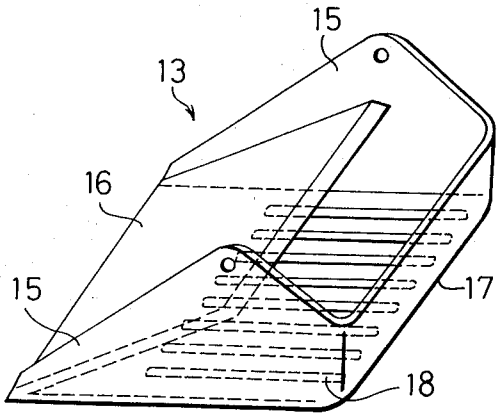
FIG. 3 is an enlarged perspective view of a scraper for use as part of the excavator.

FIG. 3 shows the construction of the scraper 13, which differs from that in FIG. 1 and has laterally spaced side plates 15 and a bottom plate 17. Between the side plates 15 is a sloping plate 16 which is above the forward portion of bottom plate 17 and extends rearwardly and upwardly. A rear portion of bottom plate 17 has slits 18 formed therein, provided to remove from the scraper 13 the portion of the dug earth/rock materials which fall as they are transferred from the sloping plate 16 to an upward conveyor 19, as is explained below.

The upward conveyor 19 slopes at a steep angle, for example, at 35 degrees, from the rear end of scraper 13 upwardly to the rear, upper part of the main frame as shown in FIG. 1. This conveyor 19 is constructed to convey a large amount of the dug earth/rock material at the steep slope, and as shown in FIG. 1, it preferably includes rake chains 20 for raking the material upwardly between slide plates 21 (FIGS. 1 and 2). The conveyor 19 has a width substantially the same as that of the rear end of the scraper 13.

Figure 4:
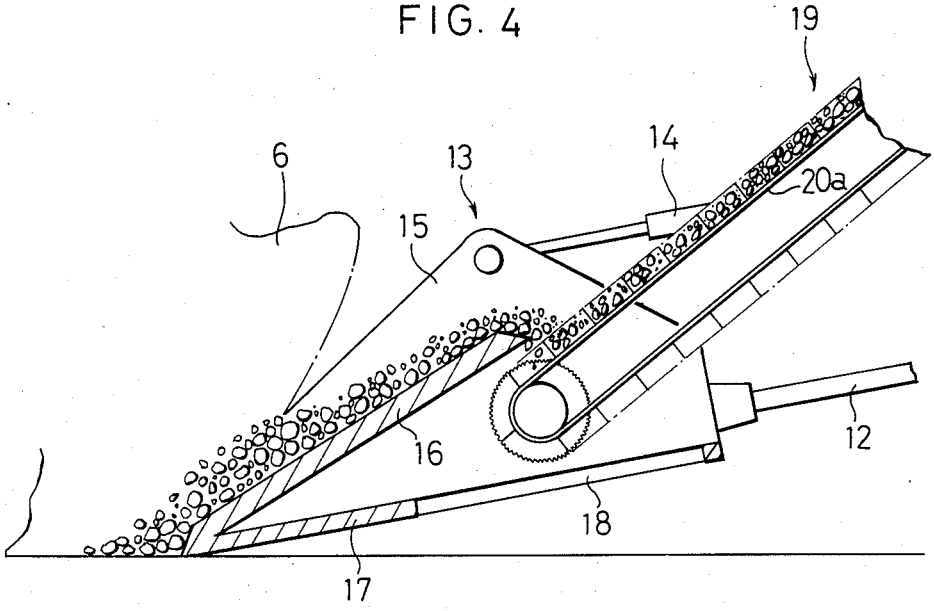
FIG. 4 is an enlarged side view partly in section showing an alternative form of scraper.

As shown in FIG. 4, the lower end of conveyor 19 is positioned in the space between the rear end of the sloping plate 16 and the bottom plate 17 of scraper 13 so that material pushed up the plate 16 falls onto the lower end of the conveyor 19.

Figure 5:
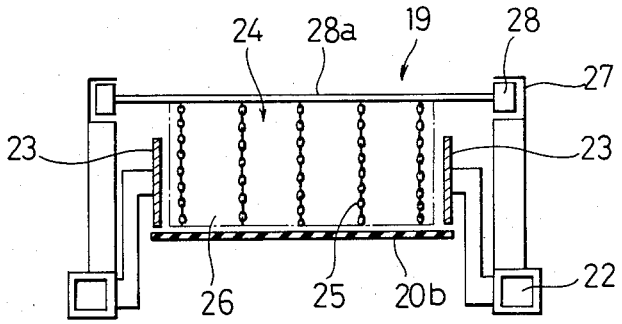
FIG. 5 is a sectional view of a part of a conveyor of the excavator.

As shown in FIG. 5, the conveyor 19 may otherwise include support frames 22, a pair of side plates 23 secured to the frames 22, and a belt 20*b* extending substantially between the lower edges of side plates 23, defining a space 24 that is U-shaped in cross section and is above the belt. The conveyor 19 may further include a pair of guide rails 27 above the frames 22, and a roller chain 28 that moves along the rails 27 and over the space 24. The roller chain 28 has a number of bars or shafts 28*a* extending between the rails 27 and across the conveyor, at regular intervals around the conveyor 19. Each bar 28*a* carries a row of chains 25, or a rake 26 shown by dash-dot lines, suspended in the space 24. The chains 25, or rakes 26, are adapted to move at the speed of the belt 20*b* and convey the earth/rock material. Instead, the chains 25 and the rakes 26 may be provided alternately along the length of the belt.

Beneath the upper, or rear, end of upward conveyor 19 is mounted a chute 29 (FIG. 1) which has a bottom outlet 31, to drop the earth/rock material from the conveyor 19 to another conveyor which is a pivotable belt conveyor 30 (FIGS. 1 and 2).

Provided on the main frame below the chute outlet 31 is a rotatable disc 32 (FIG. 1) having an upper bracket 33 thereon. The pivotable conveyor 30 is pivoted at its lower end on the bracket 33 and it extends under the outlet 31, the pivotal movement being on a vertical axis. The disc 32 may be rotated to a desired angle by a drive motor (not shown) to swing the conveyor 30 in a horizontal direction.

The outer and upper end of the pivotable conveyor 30 is suspended by a wire 36 that is connected to the piston rod 35*a* of a hydraulic cylinder 35, which is supported by a pillar 34 fixed to the main frame. The outer end of cylinder rod 35*a* and the conveyor 30 are bridged by a pivotal support 37. The telescoping movement of cylinder 35 allows the conveyor 30 to be pivoted up and down about its pivotal mounting on bracket 33.

Being constructed as described, the excavator can continuously excavate and convey a large amount of earth/rock materials, as will be summarized below.

The excavator is moved by operation of the crawlers 1, and the cutter drum 6 is moved by the cylinders 8 into the earth/rock material 40 (FIG. 1) to be excavated. The drum 6 is rotated in the direction of arrow 10 by the motor 9A, so that the rotating cutter bits 11 dig the material 40, causing the dug earth/rock material to be moved toward the scraper 13. The scraper 13 is positioned separately from the drum 6 by the hydraulic cylinders 14 at an optimum angle to collect on the upper plate of the scraper 13 the dug earth/rock material. As shown in FIG. 1, the scraper 13 is close to the drum 6 so that the bits 11 sweep the material across the scraper plate and onto the conveyor 19 where it will be conveyed upwardly by the conveyor 19.

The earth/rock material then falls from the upper end of the conveyor 19, through the chute 29 and onto the pivotable conveyor 30 at the chute outlet 31, and then it is conveyed outwardly in the direction of arrow 41. The adjustment of the hydraulic cylinder 35 and the angle of the disc 32 are adjusted to convey the earth/rock material to a desired location, or to a truck or other transporting means.

The vertical position of the drum 6 relative to the surface of the ground 40 can be adjusted so that the bits 11 cut to a desired depth, so as not to roughen the border layer or interface between multiple strata, e.g., of coal and base rock of the natural ground when digging the border layer, and not to dig, without selection, and simultaneously collect coal, for example, and base rock. In other words, only the coal or the base rock may be excavated from multiple thin layers of adjacent coal and base rock, thereby eliminating the necessity of later separation. In addition, a comparatively small amount of large-size masses of earth/rock materials are excavated, while large scale excavation is possible. Also, the upward conveyors facilitate the conveyance of a large amount of dug earth/rock material.

The cutter drum 6 and the scraper 13 may be moved up and down as required by the cylinders 8 and 14 to adjust the level of excavation, thereby permitting selective excavation.

As explained above, the excavator comprises a self-propelled main frame, a cutter drum, a scraper, an upward conveyor and a pivotable belt conveyor mounted on the main body, and it can selectively excavate a large amount of earth/rock material and convey it to another location within a short time in open-pit mining, and can easily load the material into the next transporting means such as a truck or still another belt conveyor.

We claim:

1. A continuous excavator comprising a self-propelled main frame, forwardly projecting booms pivotably supported on said frame for pivotal up and down movement, a self-rotated cutter drum supported on said booms and having a plurality of cutter bits on its outer periphery, A scraper supported on said frame behind a lower portion of said drum to collect excavated material dug by said cutter bits, a first upwardly sloping conveyor supported on said frame and having its lower end positioned adjacent said scraper for conveying the material away from said scraper, and a pivotable second conveyor supported on said frame below the upper end of said first conveyor and pivotable both horizontally and in a vertical plane, to convey the material from said first conveyor out of said excavator, said scraper comprising a bottom plate having slits through its rearward portion, and a rearwardly and upwardly sloping plate above the forward portion of said bottom plate, for guiding the material to said first conveyor.

2. A continuous excavator comprising a main frame, a cutter drum having a plurality of cutter bits secured to its outer periphery, means for rotatably mounting said drum on said frame, drive means connected to said drum for rotating said drum a scraper supported on said body adjacent a lower portion of said drum for collecting material dug by said cutter bits, and conveyor means supported on said frame adjacent said scraper and conveying material from said scraper, said scraper comprising a plate, and means for pivotably mountng said plate on said frame, said plate being mounted on a slope adjacent said lower portion of said drum such that said bits sweep jug material upwardly across said plate, said first mentioned plate forming an upper plate, and said scraper further including a lower plate below said upper plate, and said conveyor means extending between said upper and lower plates.

3. An excavator as defined in claim 2, wherein said lower plate has a plurality of openings formed therethrough.

* * * * *